US011092040B2

(12) United States Patent
Feng

(10) Patent No.: US 11,092,040 B2
(45) Date of Patent: Aug. 17, 2021

(54) COMBINED HEAT RECOVERY DEVICE

(71) Applicant: Yucheng Feng, Shanghai (CN)

(72) Inventor: Yucheng Feng, Shanghai (CN)

(73) Assignee: Yucheng Feng, Shanghai (CN)

( * ) Notice: Subject to any disclaimer, the term of this patent is extended or adjusted under 35 U.S.C. 154(b) by 0 days.

(21) Appl. No.: 16/635,500

(22) PCT Filed: Jul. 10, 2018

(86) PCT No.: PCT/CN2018/095070
§ 371 (c)(1),
(2) Date: Jan. 30, 2020

(87) PCT Pub. No.: WO2019/042019
PCT Pub. Date: Mar. 7, 2019

(65) Prior Publication Data

US 2020/0157974 A1 May 21, 2020

(30) Foreign Application Priority Data

Aug. 31, 2017 (CN) ..... 201710776178.9

(51) Int. Cl.
*F01K 11/02* (2006.01)
*F01K 13/02* (2006.01)
(Continued)

(52) U.S. Cl.
CPC ..... *F01K 11/02* (2013.01); *F01K 13/02* (2013.01); *F01K 7/22* (2013.01); *F01K 7/40* (2013.01); *F05D 2220/31* (2013.01); *F22D 1/325* (2013.01)

(58) Field of Classification Search
CPC . F01K 11/02; F01K 13/02; F01K 7/22; F01K 7/40; F01K 7/44; F01K 7/36; F05D 2220/31; F22D 1/325; F22D 1/36
(Continued)

(56) References Cited

U.S. PATENT DOCUMENTS 3,518,830 A * 7/1970 Dunnavant ..... F01K 3/265 60/657
3,568,444 A * 3/1971 Harris ..... F01K 7/02 60/653

(Continued)

FOREIGN PATENT DOCUMENTS

CN 102537933 A 7/2012
CN 202852791 U 4/2013

(Continued)

OTHER PUBLICATIONS

International Search Report for Application No. PCT/CN2018/095070, dated Oct. 11, 2018, 6 pages.

*Primary Examiner* — Hoang M Nguyen

(74) *Attorney, Agent, or Firm* — Morgan, Lewis & Bockius LLP

(57) ABSTRACT

A combined heat recovery device includes a high pressure cylinder of a steam turbine; a main steam pipe; a final-stage steam extraction pipe; an additional pipe additionally provided on the main steam pipe; a heat exchanger taking main steam in the main steam pipe as a heat source; a feedwater heater taking discharged steam from the heat exchanger as a heat source; and a steam side regulating valve provided on the additional pipe, configured to regulate main steam in the additional pipe, and capable of controlling a pressure of extracted steam behind the steam side regulating valve to control an outlet temperature of the feedwater heater to reach a preset feedwater temperature.

19 Claims, 10 Drawing Sheets

(51) Int. Cl.
*F01K 7/22* (2006.01)
*F01K 7/40* (2006.01)
*F22D 1/32* (2006.01)

(58) Field of Classification Search
USPC ..... 60/653, 654, 670, 677–680
See application file for complete search history.

(56) References Cited

U.S. PATENT DOCUMENTS 4,077,214 A * 3/1978 Burke, Jr. ..... F01K 21/02
60/512
4,099,385 A * 7/1978 Silvestri, Jr. ..... F01K 7/38
376/307
4,149,386 A * 4/1979 Luongo ..... F01K 7/24
60/663
4,274,259 A * 6/1981 Silvestri, Jr. ..... F01K 3/262
60/653
4,651,533 A * 3/1987 Ura ..... F01K 7/40
60/678
6,742,336 B2 * 6/2004 Itou ..... F01K 7/223
60/646

FOREIGN PATENT DOCUMENTS

| | | | |
|---|---|---|---|
| CN | 103335301 | A | 10/2013 |
| CN | 204494368 | U | 7/2015 |
| CN | 106051737 | A | 10/2016 |
| CN | 205878127 | U | 1/2017 |
| CN | 107388230 | A | 11/2017 |
| CN | 207298902 | U | 5/2018 |
| JP | S58108396 | A | 6/1983 |

* cited by examiner

COMBINED HEAT RECOVERY DEVICE

CROSS REFERENCE TO RELATED APPLICATIONS

This application is a United States national stage application of international patent application number PCT/CN2018/095070, filed on Jul. 10, 2018 which claims the priority of China patent application No. 201710776178.9 filed on Aug. 31, 2017 with China National Intellectual Property Administration, disclosures of which are hereby incorporated herein by reference in their entireties.

TECHNICAL FIELD

The present disclosure relates to the field of thermal power generation, for example, to a combined heat recovery device.

BACKGROUND

In China, the electric power peak shaving is mainly performed by thermal power generating units, and a low-load operation of the thermal power generating units has become the norm. With the official release of the "13th Five-Year (2016-2020) Plan for Electric Power Development", "strengthening the building of peak shaving capabilities and improving flexibility of the system" has become one of the important responsibilities of the thermal power generating units. This means even higher requirements for deep peak shaving and system flexibility of the thermal power generating units. In fact, the low-load operation of the thermal power generating units faces many difficulties in environmental protection, safety, economy, and the like, including the problem that a Selective Catalytic Reduction (SCR) denitration apparatus is required to exit operation, the problem of unstable boiler hydrodynamic force, the problem of unstable boiler combustion, the problem of low circulation efficiency, and the like.

For the problem that the SCR denitration apparatus is required to exit operation, the problem of unstable boiler hydrodynamic force, and the problem of low circulation thermal efficiency, China patent No. ZL201110459533.2 discloses an adjustable feedwater heat recovery device. Specifically, compared with a conventional steam turbine power generating unit, a final-stage extracted steam pressure arranged on a high pressure cylinder is higher than the conventional highest extracted steam pressure arranged on the high pressure cylinder; and an extracted steam regulating valve is arranged on a final-stage steam extraction pipe, and then feedwater is reheated through a feedwater heater. During operation, the valve may be used for regulating the final-stage extracted steam so that the pressure behind the extracted steam regulating valve is kept basically unchanged when the unit is in variable load, and the feedwater temperature in the boiler is kept basically unchanged through a final-stage feedwater heater.

However, the system and method provided by the patent No. ZL201110459533.2 still have its shortcomings. In particular, during each load stage of the generating unit, the steam at this stage needs to be throttled to maintain the pressure of the extracted steam regulating valve; and especially at a low load, the superheat degree of the extracted steam is large resulting in a large heat exchange temperature difference of the added feedwater heater, thereby increasing the irreversible loss. In other words, the added adjustable final-stage extracted steam is not effectively utilized. On the other hand, the high temperature of the extracted steam at the stage causes an increase in the cost of the corresponding pipes and feedwater heater, and especially with the continuing increase of the unit parameters, such as a 700° C. unit, the feedwater heater is difficult to be available with the existing manufacturing processes due to the excessively high temperature of the corresponding extracted steam. In addition, the system and the method provided by the patent No. ZL201110459533.2 also have limitations in application, and cannot be directly applied to a steam turbine unit without an additional extracted steam port.

On the other hand, in order to meet the requirements of start-stop, accidental conditions and the like of the unit, the modern thermal power generating units are all provided with bypass systems. When a unit is started, from ignition of the boiler, a large amount of steam generated by consumption of coal and fuel oil is finally sent into a condenser through a bypass system, the steam turbine is not started to stroke until the incoming steam quality of the steam turbine is qualified and the steam parameters and the like meet the stroking conditions, and finally the bypass system is not closed until the grid-connection is performed. It takes about 8 to 10 hours for the traditional thermal power generating unit to be cold started from ignition to grid connection, and during the period, a large amount of steam is sent into the condenser through the bypass system. Although a working substance is recycled, the heat is lost. In addition, in the start-up stage, the problems of low coal powder burnout rate and black smoke of fuel oil, and the problem that an air preheater of a tail flue and the like is susceptible to low temperature condensation, ash blockage and corrosion and the like exist.

SUMMARY

The following is a summary of the subject matters described herein in detail. This summary is not intended to limit the scope of the claims.

In view of the above, for the feedwater heat recovery device, the present disclosure provides a method of providing a combined heat recovery device, which can overcome the problems present in the low load and start-up phases and the defects of the existing adjustable heat recovery devices.

The present application provides a combined heat recovery device. The device includes:

- a high pressure cylinder of a steam turbine;
- a main steam pipe;
- a final-stage steam extraction pipe;
- a heat exchanger using a main steam in the main steam pipe as a heat source;
- a feedwater heater using a discharged steam from the heat exchanger as a heat source;
- an additional pipe additionally provided on the main steam pipe and configured to connect the heat exchanger with the feedwater heater in series; and
- a steam side regulating valve provided on the additional pipe, which is configured to regulate main steam in the additional pipe, and is capable of controlling a pressure of extracted steam behind the steam side regulating valve to control an outlet temperature of the feedwater heater to reach a preset feedwater temperature.

In an embodiment, the steam side regulating valve is arranged on the additional pipe located between the main steam pipe and the heat exchanger.

In an embodiment, the heat exchanger is a single heat exchanger, or a heat exchanger group composed of a plurality of heat exchangers.

In an embodiment, the heat exchanger group is composed of two or more heat exchangers connected in parallel or in series, or composed of three or more heat exchangers connected in series and in parallel in combination.

In an embodiment, a working substance heated by the heat exchanger includes at least one of: boiler hot secondary air, or boiler hot primary air and boiler feed powder.

In an embodiment, the heat exchanger is additionally provided with a bypass, and isolation valves are additionally provided in front of and behind the heat exchanger.

In an embodiment, the device further includes an additional reheat pipe additionally provided on a reheat pipe. The additional reheat pipe is connected in parallel with the additional pipe additionally provided on the main steam pipe and is then connected to the heat exchanger and the feedwater heater.

In an embodiment, the feedwater heater is a final-stage feedwater heater, the additional pipe is connected to the heat exchanger and the final-stage feedwater heater, and an isolation valve is provided on the final-stage steam extraction pipe.

In an embodiment, the feedwater heater is an additional adjustable rear final-stage feedwater heater; and the additional pipe is connected to the heat exchanger and the additional adjustable rear final-stage feedwater heater.

In an embodiment, the device further includes at least one water side regulating valve. The water side regulating valve is configured to be connected in parallel with the additional adjustable rear final-stage feedwater heater.

With the combined heat recovery device according to embodiments of the present disclosure, there is no need to provide an additional steam turbine steam extraction port. In the normal different load operation stages of the unit, the main steam is directly used to exchange heat through a heat exchanger, and is then supplied to the additional adjustable rear final-stage feedwater heater to further heat the feedwater. The main steam is throttled by a regulating valve and has larger steam superheat degree especially under low loads. However, the heat exchanger is additionally provided, so that the superheat degree of the steam can be effectively made use of. In addition, in the low load phase, the main steam is subjected to at least one of the following operations through the heat exchanger: heating the boiler hot primary air, and heating the boiler hot secondary air and the boiler feed powder, which can improve a drying output of the powder making system, improving the boiler's combustion performance, relieving the blockage of an air preheater device and the like.

After the main steam of the combined heat recovery device is subjected to heat exchange through the heat exchanger, the temperature of the steam is reduced, so that the costs of the pipe materials and the additional adjustable rear final-stage feedwater heater behind the heat exchanger can be greatly reduced. For a future high-parameter unit, the method also provides a way for solving the problem that a high-parameter feedwater heater is difficult to manufacture.

The combined heat recovery device in the embodiment may be put into use in the start-up stage of a unit, and can recover a part of heat of a large amount of steam which is originally sent into a condenser through a bypass system. The heat is used for heating boiler feed air or boiler feed powder so that the air temperature and the powder temperature in the start-up stage are directly increased; and supplements and heats boiler feedwater so that the feedwater temperature is increased, the whole boiler is indirectly supplemented and preheated, and the fuel oil consumption and coal consumption in the start-up stage can be greatly reduced. In addition, the system can be put into use in the start-up stage, so the problems of low coal powder burnout rate, black smoke of fuel oil, and low temperature condensation, ash blockage, corrosion and the like of devices such as an air preheater of a tail flue in the start-up stage are solved, the unit can be ensured to be put into the SCR denitration apparatus before grid connection, and furthermore the service life of the SCR catalyst can be prolonged.

Other aspects can be understood after the drawings and the detailed description are read and understood.

Figure 1:
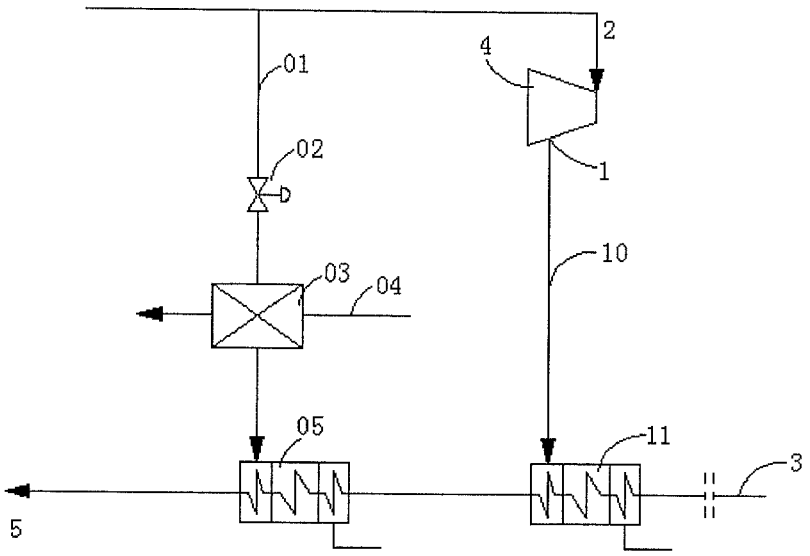
FIG. 1 is a schematic diagram of a combined heat recovery device according to Embodiment 1 of the present disclosure.

In the drawings: 1—Final-stage extracted steam port; 10—Final-stage steam extraction pipe; 11—Final-stage feedwater heater; 2—Main steam pipe; 3—Other systems; 4—High pressure cylinder; 5—Final feedwater; 6—Water side regulating valve; 7—Reheater; 8—Reheat to a medium pressure cylinder; 00, 09, and 9—Isolation valve; 01—Additional pipe; 02—Steam side regulating valve; 03, 03', and 03"—Heat exchanger; 04, 04', and 04"—Channel for a working substance heated by the heat exchanger; 05—Additional adjustable rear final-stage feedwater heater; 06—Heat exchanger inlet isolation valve; 07—Heat exchanger outlet isolation valve; and 08—Additional reheat pipe.

DETAILED DESCRIPTION

Embodiment 1

FIG. 1 is a schematic diagram of a combined heat recovery device according to Embodiment 1. In this embodiment, in addition to a final-stage extracted steam port 1, final-stage extracted steam 10, a final-stage feedwater heater 11 and a main steam pipe 2, there is additionally provided an additional pipe 01, a steam side regulating valve 02 on the additional pipe, a heat exchanger 03 and an additional adjustable rear final-stage feedwater heater 05.

The additional adjustable rear final-stage feedwater heater 05 is connected to the heat exchanger 03 and the main steam pipe 2 through the additional pipe 01. The steam side regulating valve 02 is provided on the additional pipe 01 between the main steam pipe 2 and the heat exchanger 03. The steam side regulating valve 02 is configured to regulate the main steam in the additional pipe 01, and a feedwater temperature at the outlet of the additional adjustable rear final-stage feedwater heater 05 is controlled by controlling the pressure behind the steam side regulating valve 02.

The control method of the combined heat recovery device in the embodiment is described in detail by using an example of a 1000 MW unit of a power plant, where a steam turbine is a super-supercritical single-shaft, one-time reheating and four-cylinder four-steam-discharge condensing steam turbine.

For example, the main steam parameter under rated conditions (1000 WM) of the unit is 27 MPa/600° C. During the operation of the unit, along with a reduction in the unit load, the pressure entering the additional adjustable rear final-stage feedwater heater is controlled to be about 8.5 MPa by regulating the steam side regulating valve so as to maintain a temperature of the feedwater at about 300° C. The heat exchanger is additionally provided to heat boiler hot primary air or boiler hot secondary air or boiler feed powder, so the superheat degree of additional adjustable rear final-stage extracted steam can be effectively utilized, the temperature after the steam passes through the heat exchanger can be reduced to about 360° C., and then the steam enters the additional adjustable rear final-stage feedwater heater to heat the feedwater. All advantages of an adjustable feedwater heat recovery device are equipped with, and meanwhile a steam inlet temperature of the additional adjustable rear final-stage feedwater heater is reduced, and the investment cost can be reduced. In addition, heat of the extracted steam is subjected to at least one of the following operations: heating the boiler hot primary air, and heating the boiler hot secondary air and the boiler feed powder, and is indirectly sent into the boiler, so that part of fuel of the boiler is replaced, the combustion condition of the boiler is effectively improved, and the economy of the unit can be greatly improved. In the embodiment, the heat exchanger may be additionally provided with a bypass, and isolation valves may be additionally provided in front of and behind the heat exchanger, so that the bypass can be used for switching and operation when the heat exchanger has faults such as leakage in the operation.

During the start-up stage of the unit, from ignition of the boiler, steam generated by consumption of coal and fuel may enter the heat exchanger 03 through the additional pipe 01 to heat the boiler hot primary air or the boiler hot secondary air or the boiler feed powder, so that heat is sent into the boiler and fuel of the boiler is replaced, and then the heat enters the additional adjustable rear final-stage feedwater heater 05 to supplement and heat boiler feedwater. The temperature of the feedwater in the start-up stage is increased, the inlet enthalpy deficiency of a waterwall in the start-up stage is reduced, so that the problem of unstable hydrodynamic force in the start-up stage is solved, favorable conditions are created for quick start-up of the unit, the start-up energy consumption is greatly reduced, and the problems of low coal powder burnout rate, black fuel oil, and low temperature condensation, ash blockage, corrosion and the like of devices such as an air preheater of a tail flue and the like in the traditional start-up stage are solved.

Embodiment 2

Figure 2:
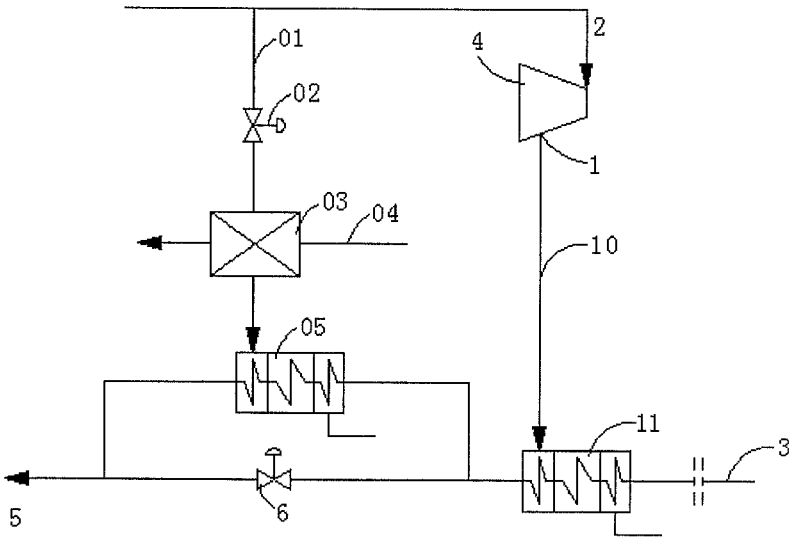
FIG. 2 is a schematic diagram of a combined heat recovery device according to Embodiment 2 of the present disclosure.

FIG. 2 is a schematic diagram of a combined heat recovery device according to Embodiment 2. In the embodiment, in addition to a final-stage extracted steam port 1, final-stage extracted steam 10, a final-stage feedwater heater 11 and a main steam pipe 2, there is additionally provided an additional pipe 01, a steam side regulating valve 02 on the additional pipe, a heat exchanger 03, an additional adjustable rear final-stage feedwater heater 05 and a water side regulating valve 6.

The difference between Embodiment 2 and Embodiment 1 is that the water side regulating valve 6 is additionally provided. The water side regulating valve 6 is provided to be connected in parallel with the additional adjustable rear final-stage feedwater heater 05. Therefore, the additional adjustable rear final-stage feedwater heater 05 may be designed as a partial capacity feedwater heater, and the cost of the heater is reduced.

The method of using the combined heat recovery device of Embodiment 2 is different from the method of the embodiment 1 in that a temperature of the feedwater is a temperature of feedwater mixed from the outlet of the additional adjustable rear final-stage feedwater heater 05 and the outlet of the water side regulating valve 6. The rest in Embodiment 2 is consistent with that in Embodiment 1 and is not described in detail herein.

Embodiment 3

Figure 3:
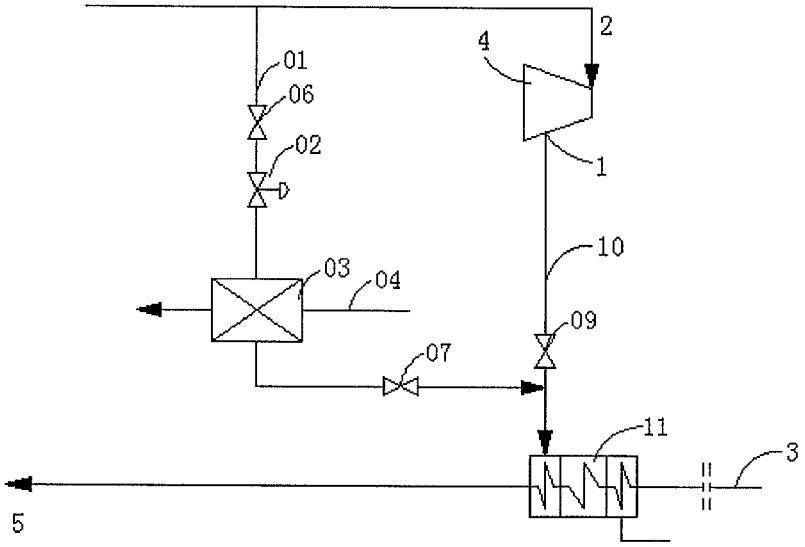
FIG. 3 is a schematic diagram of a combined heat recovery device according to Embodiment 3 of the present disclosure.

FIG. 3 is a schematic diagram of a combined heat recovery device according to Embodiment 3. In the embodiment, in addition to a final-stage extracted steam port 1, final-stage extracted steam 10, a final-stage feedwater heater 11 and a main steam pipe 2, there is additionally provided an additional pipe 01, a steam side regulating valve 02 on the additional pipe, a heat exchanger inlet isolation valve 06, a heat exchanger outlet isolation valve 07 and a heat exchanger 03.

The difference between Embodiment 3 and Embodiment 1 is that no additional adjustable rear final-stage feedwater heater 05 is additionally provided. Steam passing through the heat exchanger is directly sent to the original final-stage feedwater heater 11 through a pipe. Embodiment 3 provides advantages that the additional adjustable rear final-stage feedwater heater 05 is saved, thereby reducing the investment, and the steam heat which is intended to be wasted by a bypass system can be completely recovered in the start-up stage of the unit as in Embodiment 1. On the other hand, the final-stage feedwater heater 11 may also be used for supplementing and heating feedwater, so as to ensure the temperature of the feedwater in the start-up stage, the requirements of denitration, stable hydrodynamic force, stable combustion, high combustion efficiency and the like in the start-up stage are met, and the problems of low temperature condensation, ash blockage, corrosion and the like are avoided.

In the normal operation stage of the unit, when the load is higher, the final-stage extracted steam 10 may still be used to be heated by the final-stage feedwater heater 11, and when the load is low to a preset degree, an isolation valve 09 may be closed, the heat exchanger inlet isolation valve 06 and the heat exchanger outlet isolation valve 07 are opened, and the additionally provided system is switched to for operation. When the original system needs to be switched back, the heat exchanger inlet isolation valve 06 and the heat exchanger outlet isolation valve 07 are closed. Therefore, the online switching and operation of two paths of steam to the final-stage feedwater heater 11 can be achieved through the isolation valve 09, the heat exchanger inlet isolation valve 06 and the heat exchanger outlet isolation valve 07.

The rest in Embodiment 3 is consistent with those in Embodiment 1 and is not described in detail herein.

Embodiment 4

Figure 4:
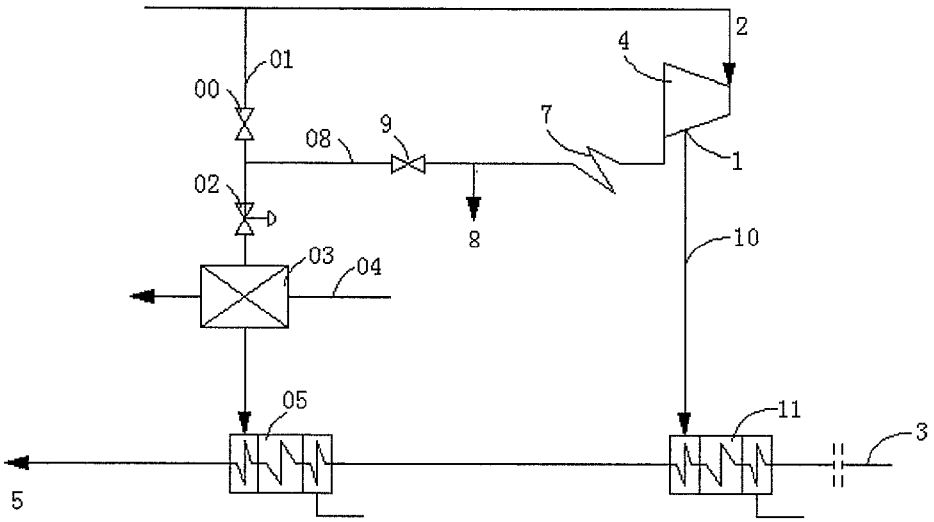
FIG. 4 is a schematic diagram of a combined heat recovery device according to Embodiment 4 of the present disclosure.

FIG. 4 is a schematic diagram of a combined heat recovery device according to Embodiment 4. In the embodiment, in addition to a final-stage extracted steam port 1, final-stage extracted steam 10, a final-stage feedwater heater 11 and a main steam pipe 2, there is additionally provided an additional pipe 01, an isolation valve 00 and a steam side regulating valve 02 on the additional pipe, a heat exchanger 03 and an additional adjustable rear final-stage feedwater heater 05. An additional reheat pipe 08 to the heat exchanger 03 is additionally provided on the steam pipe located from a reheater to a medium pressure cylinder.

The difference between Embodiment 4 and Embodiment 1 is that the additional reheat pipe 08 to the heat exchanger is additionally provided. Embodiment 4 provides advantages that in the start-up stage of the unit, to protect the reheater, a part of steam has to be heated by the reheater 7 through the bypass system (high bypass) and then becomes reheat, and in the conventional case, the part of reheat is sent to the condenser through the bypass system (low bypass), while in Embodiment 4, the additional reheat pipe 08 to the heat exchanger 03 is additionally provided, so the reheat steam flowing through the reheater in the start-up stage can be recovered. The isolation valve 9 is provided, so the switching between and operation of the inlet steam of the 08 path and the inlet steam of the 01 path can be achieved.

The rest in Embodiment 4 is consistent with those in Embodiment 1 and is not to be described in detail herein.

Embodiment 5

Figure 5:
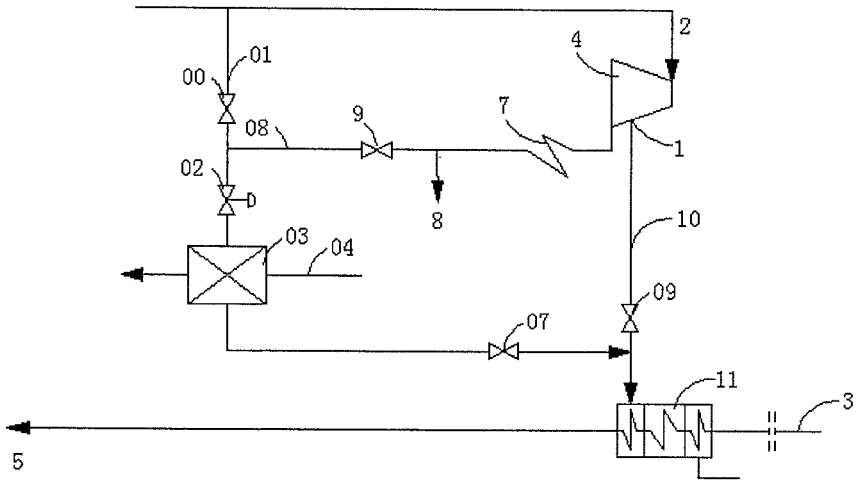
FIG. 5 is a schematic diagram of a combined heat recovery device according to Embodiment 5 of the present disclosure.

FIG. 5 is a schematic diagram of a combined heat recovery device according to Embodiment 5. In the embodiment, in addition to a final-stage extracted steam port 1, final-stage extracted steam 10, a final-stage feedwater heater 11 and a main steam pipe 2, there is additionally provided an additional pipe 01, an isolation valve 00 and a steam side regulating valve 02 on the additional pipe, a heat exchanger 03 and an additional adjustable rear final-stage feedwater heater 05. An additional reheat pipe 08 to the heat exchanger 03 is additionally provided on the steam pipe located from a reheater to a medium pressure cylinder.

The difference between Embodiment 5 and Embodiment 4 is that no additional adjustable rear final-stage feedwater heater 05 is additionally provided. Steam passing through the heat exchanger is directly sent to a final-stage feedwater heater 11 through a pipe. Embodiment 5 provides advantages that the additional adjustable rear final-stage feedwater heater 05 is saved, thereby reducing the cost, and the steam heat which is intended to be wasted by a bypass system can be completely recovered in the start-up stage of the unit as in Embodiment 4. On the other hand, the final-stage feedwater heater 11 may also be used for supplementing and heating feedwater, so as to ensure the temperature of the feedwater in the start-up stage, the requirements of denitration, stable hydrodynamic force, stable combustion, high combustion efficiency and the like in the start-up stage are met, and the problems of low temperature condensation, ash blockage, corrosion and the like are avoided.

In the normal operation stage of the unit, when the load is higher, the final-stage extracted steam 10 may still be used to be heated by the final-stage feedwater heater 11, and when the load is low to a preset degree, an isolation valve 09 and an isolation valve 9 may be closed, a heat exchanger outlet isolation valve 07 is opened, and the additionally provided system is switched to for operation. That is, main steam is used for heating the boiler feed air or boiler feed power through the heat exchanger 03, and then supplementing and heating boiler feedwater. The heat exchanger outlet isolation valve 07 is closed when the original system needs to be switched back.

The rest in Embodiment 5 is consistent with those in Embodiment 4 and is not to be described in detail herein.

Embodiment 6

Figure 6:
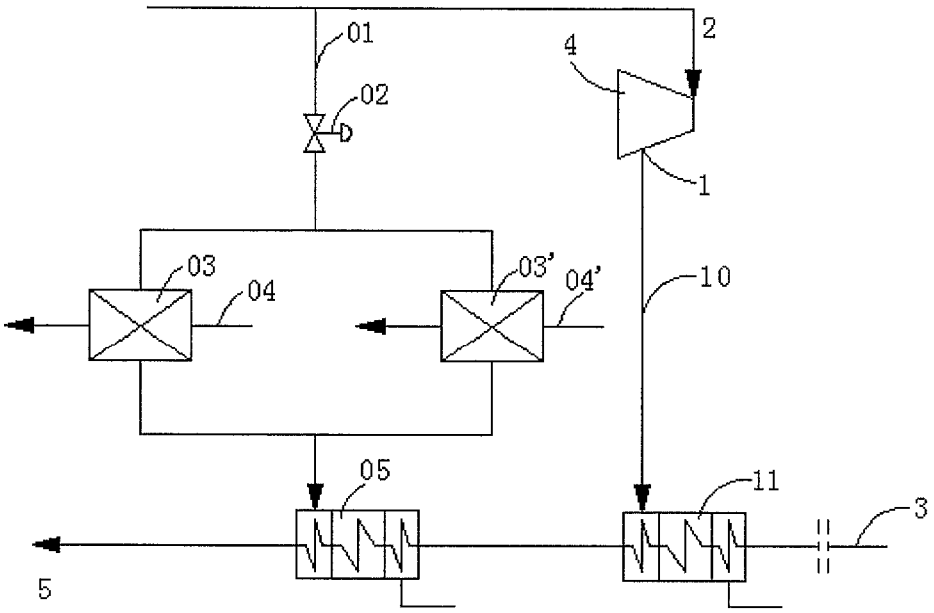
FIG. 6 is a schematic diagram of a combined heat recovery device according to Embodiment 6 of the present disclosure.

FIG. 6 is a schematic diagram of a combined heat recovery device according to Embodiment 6. In this embodiment, in addition to a final-stage extracted steam port 1, final-stage extracted steam 10, a final-stage feedwater heater 11 and a main steam pipe 2, there is additionally provided an additional pipe 01, a steam side regulating valve 02 on the additional pipe, heat exchangers 03 and 3' and an additional adjustable rear final-stage feedwater heater 05.

The main difference between Embodiment 6 and Embodiment 1 is that the heat exchangers 03 and 03' are connected in parallel, and the working substance heated by the heat exchangers may be different. For example, the working substance heated by the heat exchangers includes a combination of the following two operations: heating boiler hot primary air, and heating boiler hot secondary air and boiler feed powder.

The method of using the combined heat recovery device of the embodiment 6 is the same as the method of Embodiment 1, and is not to be described herein again.

Embodiment 7

Figure 7:
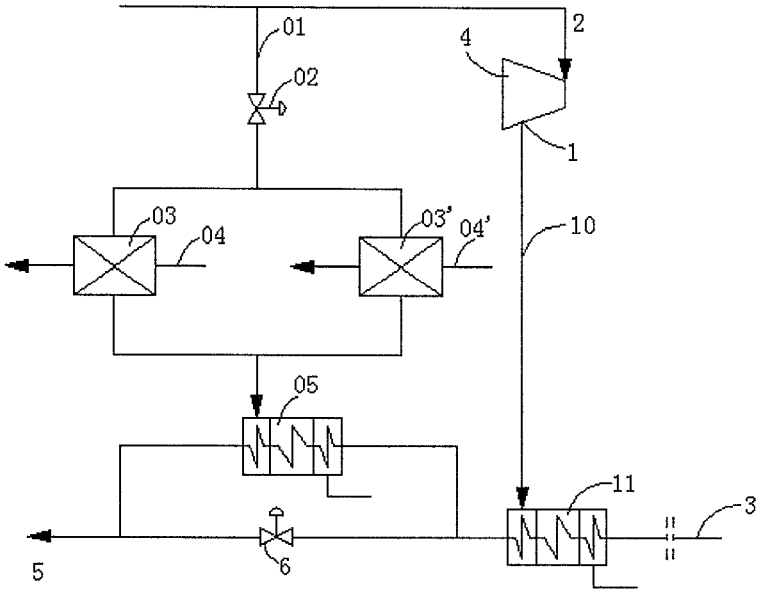
FIG. 7 is a schematic diagram of a combined heat recovery device according to Embodiment 7 of the present disclosure.

FIG. 7 is a schematic diagram of a combined heat recovery device according to the embodiment 7. In the embodiment, in addition to a final-stage extracted steam port 1, final-stage extracted steam 10, a final-stage feedwater heater 11 and a main steam pipe 2, there is additionally provided an additional pipe 01, a steam side regulating valve 02 on the additional pipe, heat exchangers 03 and 03', an additional adjustable rear final-stage feedwater heater 05 and a water side regulating valve 6.

The difference between Embodiment 7 and Embodiment 6 is that the water side regulating valve 6 is additionally provided and is connected in parallel with the additional adjustable rear final-stage feedwater heater 05. Therefore, the additional adjustable rear final-stage feedwater heater 05 may be designed as a partial capacity feedwater heater, thereby reducing the cost of the heater.

The method of using the combined heat recovery device of Embodiment 7 is different from the method of Embodiment 1 in that a temperature of the feedwater is a temperature of feedwater mixed from the outlet of the additional adjustable rear final-stage feedwater heater 05 and the outlet of the water side regulating valve 6.

The method of using the combined heat recovery device of Embodiment 7 is the same as the method of Embodiment 6, and is not to be described herein again.

Embodiment 8

Figure 8:
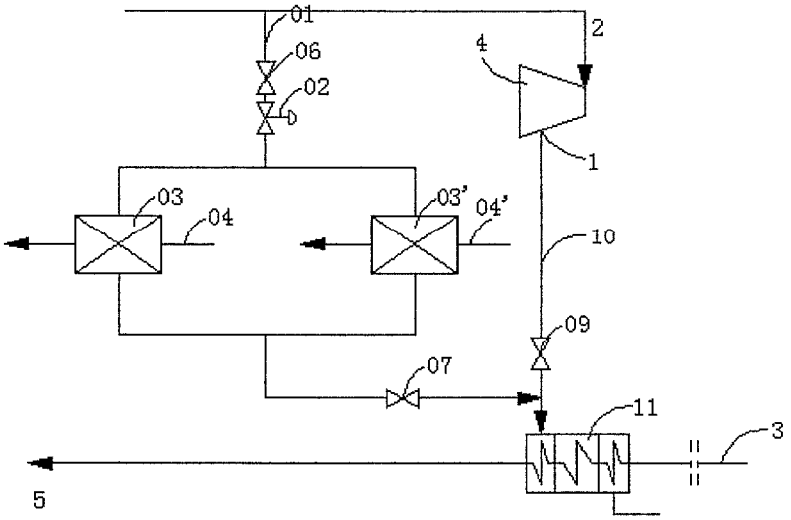
FIG. 8 is a schematic diagram of a combined heat recovery device according to Embodiment 8 of the present disclosure.

FIG. 8 is a schematic diagram of a combined heat recovery device according to Embodiment 8. In this embodiment, in addition to a final-stage extracted steam port 1, final-stage extracted steam 10, a final-stage feedwater heater 11 and a main steam pipe 2, there is additionally provided an additional pipe 01, a steam side regulating valve 02 on the additional pipe, and heat exchangers 03 and 03'.

The difference between Embodiment 8 and Embodiment 6 is that no additional adjustable rear final-stage feedwater heater 05 is additionally provided. Steam passing through the heat exchanger is directly sent to a final-stage feedwater heater 11 through a pipe. Embodiment 8 provides advantages that the additional adjustable rear final-stage feedwater heater 05 is saved, thereby reducing the investment, and the steam heat which is intended to be wasted by a bypass system can be completely recovered in the start-up stage of the unit as in Embodiment 6. On the other hand, the final-stage feedwater heater 11 may also be used for supplementing and heating feedwater, so as to ensure the temperature of the feedwater in the start-up stage, the requirements of denitration, stable hydrodynamic force, stable combustion, high combustion efficiency and the like in the start-up stage are met, and the problems of low temperature condensation, ash blockage, corrosion and the like are avoided.

In the normal operation stage of the unit, when the load is higher, the final-stage extracted steam 10 may still be used to be heated by the final-stage feedwater heater 11, and when the load is low to a preset degree, an isolation valve 09 may be closed, the heat exchanger inlet isolation valve 06 and the heat exchanger outlet isolation valve 07 are opened, and the additionally provided system is switched to for operation. That is, main steam is used for performing, through the heat exchangers 03 and 03', at least one of the following operations: heating the boiler hot secondary air, and heating the boiler hot primary air and the boiler feed powder, and then for supplementing and heating boiler feedwater. When the original system needs to be switched back, the heat exchanger inlet isolation valve 06 and the heat exchanger outlet isolation valve 07 are closed. Therefore, the online switching and operation of two paths of steam to the final-stage feedwater heater 11 can be achieved through the isolation valve 09, the heat exchanger inlet isolation valve 06 and the heat exchanger outlet isolation valve 07.

The rest in Embodiment 8 is consistent with those in Embodiment 6 and is not to be described in detail herein.

Embodiment 9

Figure 9:
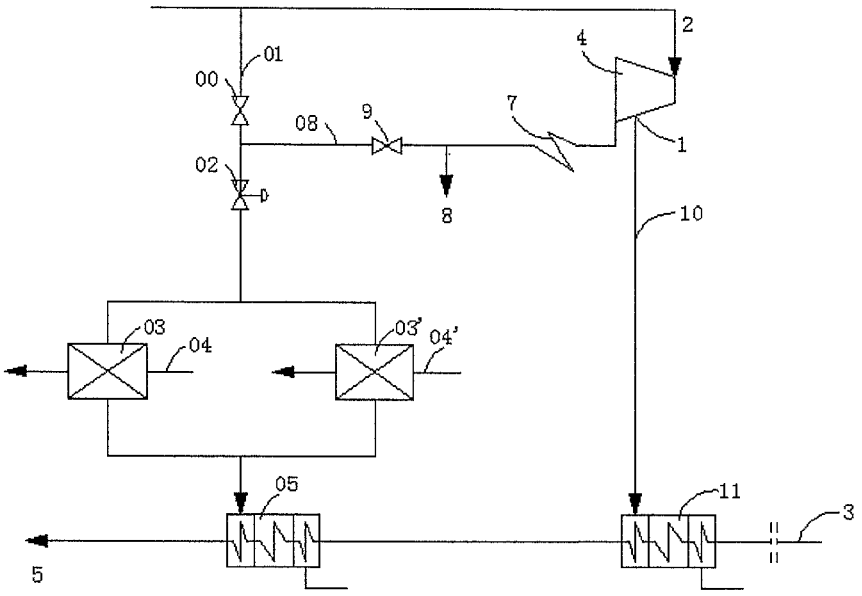
FIG. 9 is a schematic diagram of a combined heat recovery device according to Embodiment 9 of the present disclosure.

FIG. 9 is a schematic diagram of a combined heat recovery device according to Embodiment 9. In the embodiment, in addition to a final-stage extracted steam port 1, final-stage extracted steam 10, a final-stage feedwater heater 11 and a main steam pipe 2, there is additionally provided an additional pipe 01, an isolation valve 00 and a steam side regulating valve 02 on the additional pipe, heat exchangers 03 and 03' and an additional adjustable rear final-stage feedwater heater 05. An additional reheat pipe 08 to the heat exchanger 03 is additionally provided on the steam pipe located from a reheater to a medium pressure cylinder.

The difference between Embodiment 9 and Embodiment 6 is that the additional reheat pipe 08 to the heat exchanger is additionally provided. Embodiment 9 provides advantages that in the start-up stage of the unit, to protect the reheater, a part of steam is heated by the reheater 7 through the bypass system (high bypass) and then becomes reheat, and in the conventional case, the part of reheat is sent to the condenser through the bypass system (low bypass), while in Embodiment 9, the additional reheat pipe 08 to the heat exchanger 03 is additionally provided, so the reheat steam flowing through the reheater in the start-up stage can be recovered. The isolation valve 9 is provided, so the switching between and operation of the inlet steam of the 08 path and the inlet steam of the 01 path can be achieved.

The rest in Embodiment 9 is consistent with those in Embodiment 6 and is not to be described in detail herein.

Embodiment 10

Figure 10:
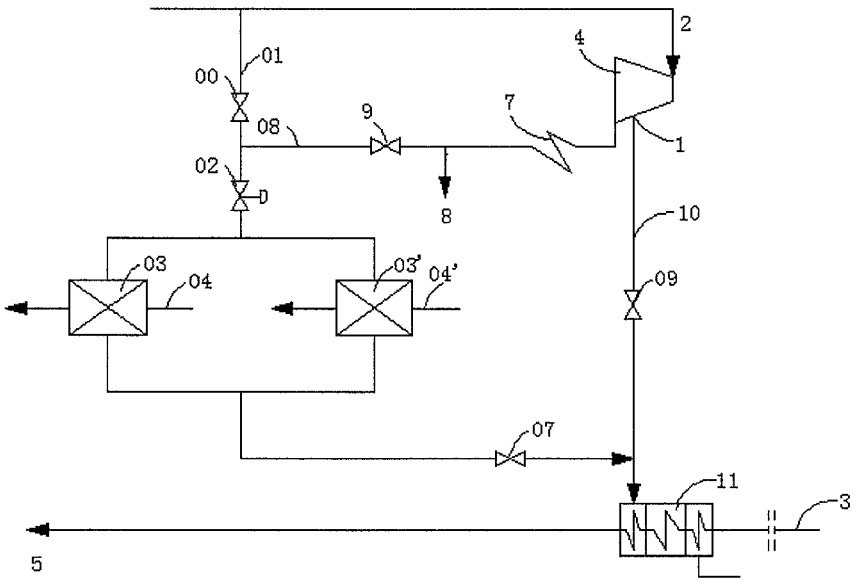
FIG. 10 is a schematic diagram of a combined heat recovery device according to Embodiment 10 of the present disclosure.

FIG. 10 is a schematic diagram of a combined heat recovery device according to Embodiment 10. In the embodiment, in addition to a final-stage extracted steam port 1, final-stage extracted steam 10, a final-stage feedwater heater 11 and a main steam pipe 2, there is additionally provided an additional pipe 01, an isolation valve 00 and a steam side regulating valve 02 on the additional pipe, heat exchangers 03 and 03' and an additional adjustable rear final-stage feedwater heater 05 are additionally provided. An additional reheat pipe 08 to the heat exchanger 03 is additionally provided on the steam pipe located from a reheater to a medium pressure cylinder.

The difference between Embodiment 10 and Embodiment 9 is that no additional adjustable rear final-stage feedwater heater 05 is additionally provided. Steam passing through the heat exchanger is directly sent to a final-stage feedwater heater 11 through a pipe. Embodiment 10 provides advantages that the additional adjustable rear final-stage feedwater heater 05 is saved, the investment is reduced, and the steam heat which is intended to be wasted by a bypass system can be completely recovered in the start-up stage of the unit as in Embodiment 4. On the other hand, the final-stage feedwater heater 11 may also be used for supplementing and heating feedwater, so as to ensure the temperature of the feedwater in the start-up stage is ensured, the requirements of denitration, stable hydrodynamic force, stable combustion, high combustion efficiency and the like in the start-up stage are met, and the problems of low temperature condensation, ash blockage, corrosion and the like are avoided.

In the normal operation stage of the unit, when the load is higher, the final-stage extracted steam 10 may still be used to be heated by the final-stage feedwater heater 11, and when the load is low to a preset degree, an isolation valve 09 and an isolation valve 9 may be closed, a heat exchanger outlet isolation valve 07 is opened, and the additionally provided system is switched to for operation. That is, main steam is used for heating the boiler feed air or boiler feed power through the heat exchanger 03, and then supplementing and heating boiler feedwater. The heat exchanger outlet isolation valve 07 is closed when the original system needs to be switched back.

The rest in Embodiment 10 is consistent with those in Embodiment 9 and is not to be described in detail herein.

Embodiment 11

Figure 11:
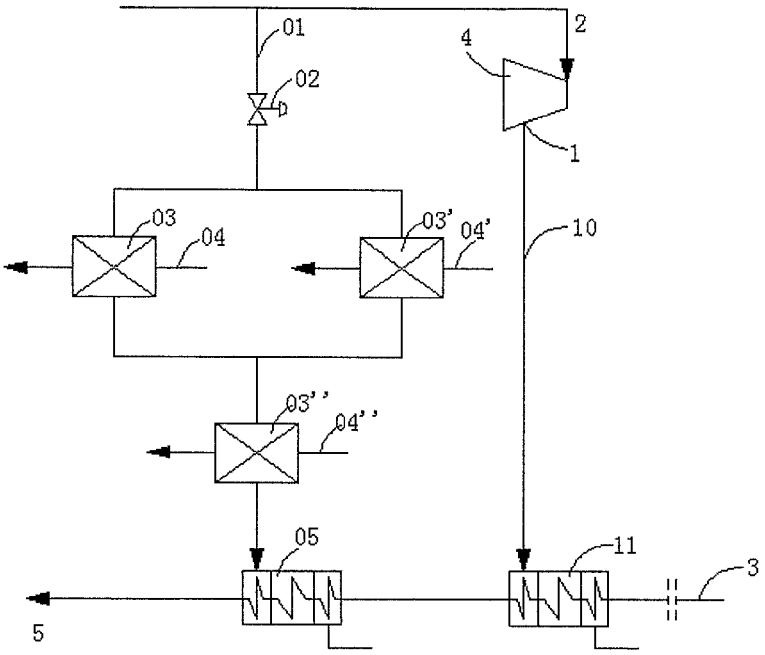
FIG. 11 is a schematic diagram of a combined heat recovery device according to Embodiment 11 of the present disclosure.

FIG. 11 is a schematic diagram of a combined heat recovery device according to Embodiment 11. In the embodiment, in addition to a final-stage extracted steam port 1, final-stage extracted steam 10, a final-stage feedwater heater 11 and a main steam pipe 2, there is additionally provided an additional pipe 01, a steam side regulating valve 02 on the additional pipe, heat exchangers 03, 03' and 03" and an additional adjustable rear final-stage feedwater heater 05.

The main difference between Embodiment 11 and Embodiment 6 is that the heat exchangers 03 and 03' are connected in parallel and then are connected in series with the heat exchanger 03", and the working substance heated by the heat exchangers may be different. For example, the heated working substance includes at least one of: boiler hot primary air, boiler hot secondary air, or boiler feed powder.

The method of using the device of Embodiment 11 is the same as the method of Embodiment 6, and is not to be described herein again.

Embodiment 12

Figure 12:
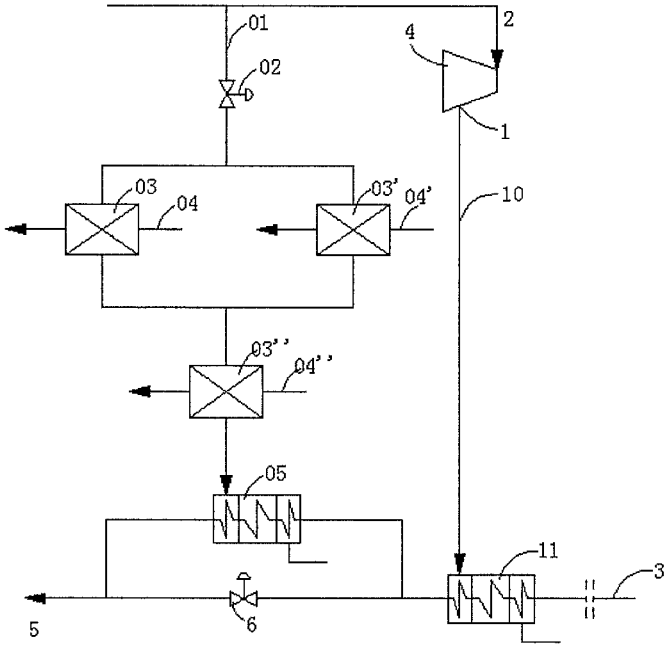
FIG. 12 is a schematic diagram of a combined heat recovery device according to Embodiment 12 of the present disclosure.

FIG. 12 is a schematic diagram of a combined heat recovery device according to Embodiment 12. In the embodiment, in addition to a final-stage extracted steam port 1, final-stage extracted steam 10, a final-stage feedwater heater 11 and a main steam pipe 2, there is additionally provided an additional pipe 01, a steam side regulating valve 02 on the additional pipe, and heat exchangers 03, 03' and 03".

The difference between Embodiment 12 and Embodiment 11 is that a water side regulating valve 6 is additionally provided and is connected in parallel with an additional adjustable rear final-stage feedwater heater 05. Therefore, the additional adjustable rear final-stage feedwater heater 05 may be designed as a partial capacity feedwater heater, and the cost of the heater is reduced.

The method of using the combined heat recovery device of Embodiment 12 is different from the method of Embodiment 8 in that a temperature of the feedwater is a temperature of feedwater mixed from the outlet of the additional adjustable rear final-stage feedwater heater 05 and the outlet of the water side regulating valve 6. The rest in Embodiment 12 is consistent with those in Embodiment 8 and is not to be described in detail herein.

The method of using the combined heat recovery device of Embodiment 12 is the same as the method of Embodiment 11, and is not to be described herein again.

Embodiment 13

Figure 13:
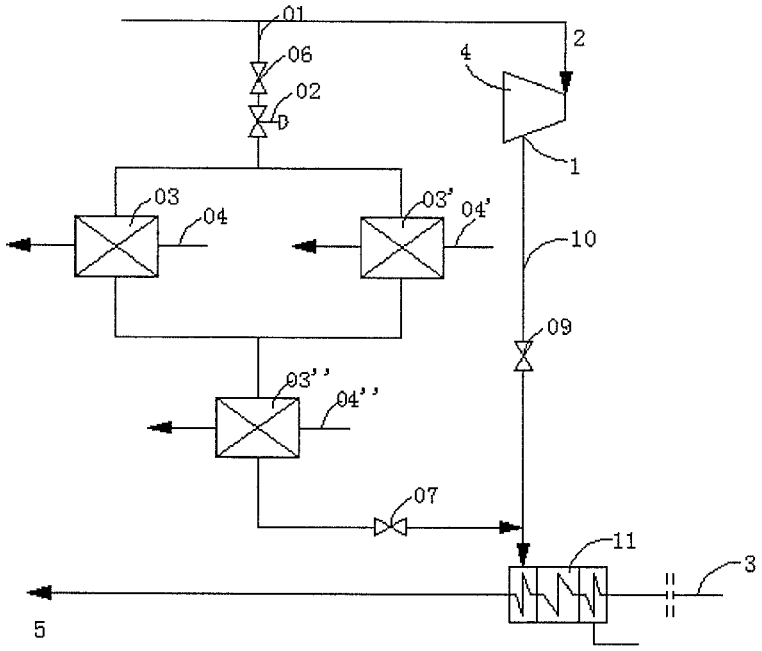
FIG. 13 is a schematic diagram of a combined heat recovery device according to Embodiment 13 of the present disclosure.

FIG. 13 is a schematic diagram of a combined heat recovery device according to Embodiment 13. In this embodiment, in addition to a final-stage extracted steam port 1, final-stage extracted steam 10, a final-stage feedwater heater 11 and a main steam pipe 2, there is additionally provided an additional pipe 01, a steam side regulating valve 02 on the additional pipe, and heat exchangers 03, 03' and 03".

The difference between Embodiment 13 and Embodiment 11 is that no additional adjustable rear final-stage feedwater heater 05 is additionally provided. Steam passing through the heat exchanger is directly sent to a final-stage feedwater heater 11 through a pipe. Embodiment 13 provides advantages that the additional adjustable rear final-stage feedwater heater 05 is saved, thereby reducing the investment, and the steam heat which is intended to be wasted by a bypass system can be completely recovered in the start-up stage of the unit as in Embodiment 11. On the other hand, the final-stage feedwater heater 11 may also be used for supplementing and heating feedwater, so that the temperature of the feedwater in the start-up stage is ensured, the requirements of denitration, stable hydrodynamic force, stable combustion, high combustion efficiency and the like in the start-up stage are met, and the problems of low temperature condensation, ash blockage, corrosion and the like are avoided.

In the normal operation stage of the unit, when the load is higher, the final-stage extracted steam 10 may still be used to be heated by the final-stage feedwater heater 11, and when the load is low to a preset degree, an isolation valve 09 may be closed, the heat exchanger inlet isolation valve 06 and the heat exchanger outlet isolation valve 07 are opened, and the additionally provided system is switched to for operation. That is, main steam is used for performing, through the heat exchangers 03 and 03', at least one of the following operations: heating the boiler hot secondary air, and heating the boiler hot primary air and the boiler feed powder, and then for supplementing and heating boiler feedwater. When the original system needs to be switched back, the heat exchanger inlet isolation valve 06 and the heat exchanger outlet isolation valve 07 are closed. Therefore, the online switching and operation of two paths of steam to the final-stage feedwater heater 11 can be achieved through the isolation valve 09, the heat exchanger inlet isolation valve 06 and the heat exchanger outlet isolation valve 07.

The rest in Embodiment 13 is consistent with those in Embodiment 11 and is not to be described in detail herein.

Embodiment 14

Figure 14:
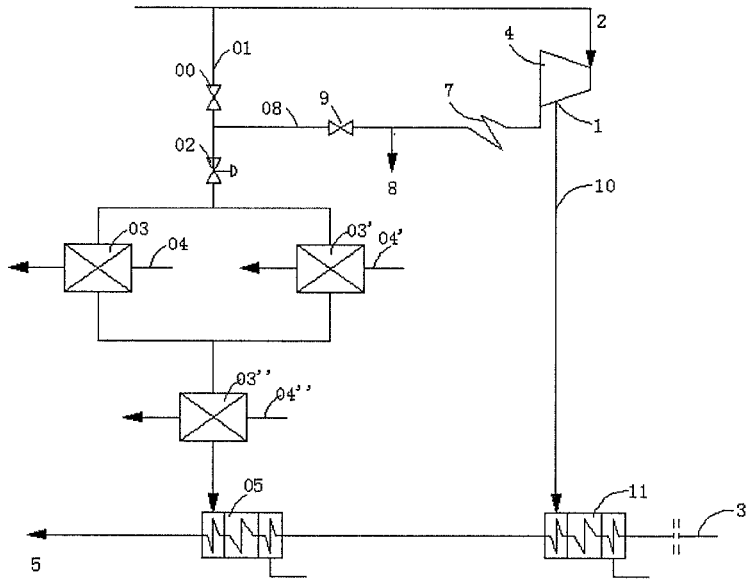
FIG. 14 is a schematic diagram of a combined heat recovery device according to Embodiment 14 of the present disclosure.

FIG. 14 is a schematic diagram of a combined heat recovery device according to Embodiment 14. In this embodiment, in addition to a final-stage extracted steam port 1, final-stage extracted steam 10, a final-stage feedwater heater 11 and a main steam pipe 2, there is additionally provided an additional pipe 01, an isolation valve 00 and a steam side regulating valve 02 on the additional pipe, heat exchangers 03, 03' and 03" and an additional adjustable rear final-stage feedwater heater 05 are additionally provided. An additional reheat pipe 08 to the heat exchanger 03 is additionally provided on the steam pipe located from a reheater to a medium pressure cylinder.

The difference between Embodiment 14 and Embodiment 11 is that the additional reheat pipe 08 to the heat exchanger is additionally provided. Embodiment 14 provides advantages that in the start-up stage of the unit, to protect a reheater, a part of steam is heated by the reheater 7 through the bypass system (high bypass) and then becomes reheat, and in the conventional case, the part of reheat is sent to the condenser through the bypass system (low bypass), while in Embodiment 9, the additional reheat pipe 08 to the heat exchanger 03 is additionally provided, so the reheat steam flowing through the reheater in the start-up stage can be recovered. The isolation valve 9 is provided, so the switching between and operation of the inlet steam of the 08 path and the inlet steam of the 01 path can be achieved.

The rest in Embodiment 14 is consistent with those in Embodiment 11 and is not to be described in detail herein.

Embodiment 15

Figure 15:
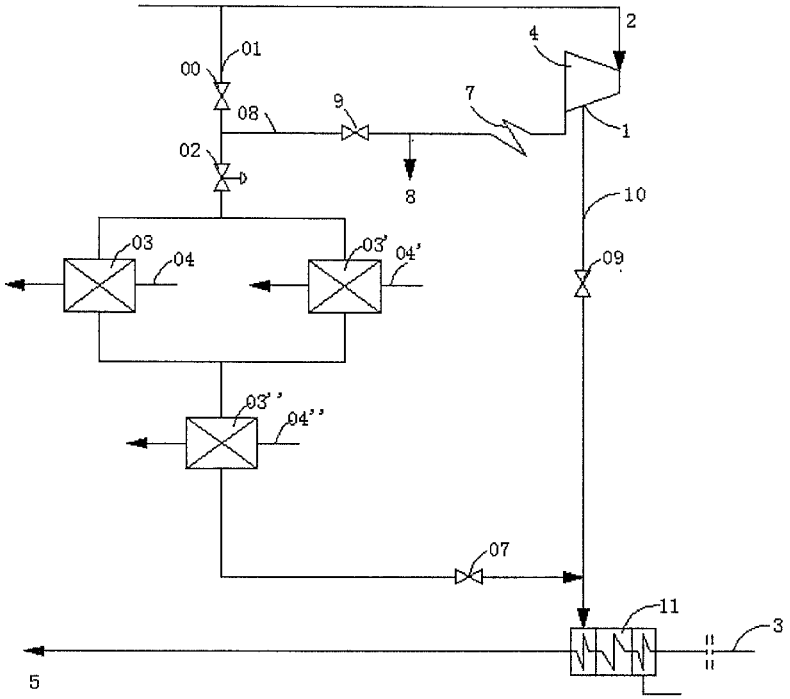
FIG. 15 is a schematic diagram of a combined heat recovery device according to Embodiment 15 of the present disclosure.

FIG. 15 is a schematic diagram of a combined heat recovery device according to Embodiment 15. In the embodiment, in addition to a final-stage extracted steam port 1, final-stage extracted steam 10, a final-stage feedwater heater 11 and a main steam pipe 2, there is additionally provided an additional pipe 01, an isolation valve 00 and a steam side regulating valve 02 on the additional pipe, heat exchangers 03, 03' and 03" and an additional adjustable rear final-stage feedwater heater 05. An additional reheat pipe 08 to the heat exchanger 03 is additionally provided on the steam pipe located from a reheater to a medium pressure cylinder.

The difference between Embodiment 15 and Embodiment 14 is that no additional adjustable rear final-stage feedwater heater 05 is additionally provided. Steam passing through the heat exchanger is directly sent to the original final-stage feedwater heater 11 through a pipe. Embodiment 15 provides advantages that the additional adjustable rear final-stage feedwater heater 05 is saved, thereby reducing the investment, and the steam heat which is intended to be wasted by a bypass system can be completely recovered in the start-up stage of the unit as in Embodiment 4. On the other hand, the final-stage feedwater heater 11 may also be used for supplementing and heating feedwater, so that the temperature of the feedwater in the start-up stage is ensured, the requirements of denitration, stable hydrodynamic force, stable combustion, high combustion efficiency and the like in the start-up stage are met, and the problems of low temperature condensation, ash blockage, corrosion and the like are avoided.

In the normal operation stage of the unit, when the load is higher, the final-stage extracted steam 10 may still be used to be heated by the final-stage feedwater heater 11, and when the load is low to a preset degree, an isolation valve 09 and an isolation valve 9 may be closed, a heat exchanger outlet isolation valve 07 is opened, and the additionally provided system is switched to for operation. That is, main steam is used for heating the boiler feed air or boiler feed power through the heat exchanger 03, and then supplementing and heating boiler feedwater. The heat exchanger outlet isolation valve 07 is closed when the original system needs to be switched back.

The rest in Embodiment 15 is consistent with those in Embodiment 14 and is not to be described in detail herein.

Embodiment 16

Figure 16:
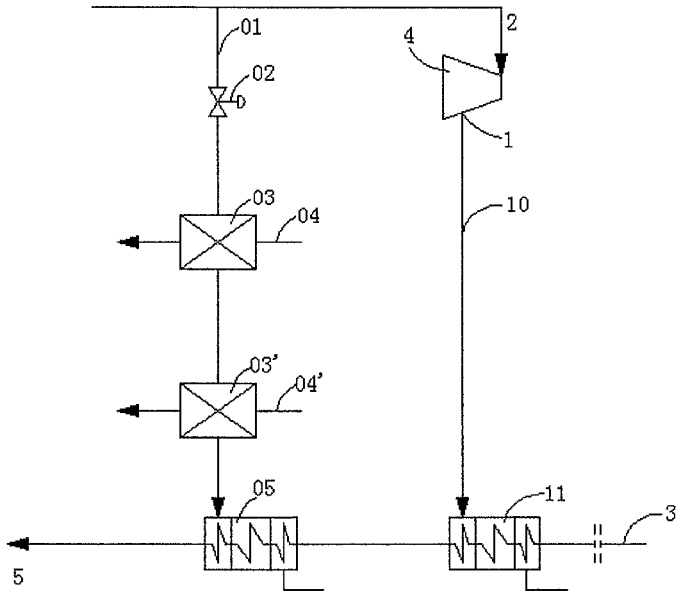
FIG. 16 is a schematic diagram of a combined heat recovery device according to Embodiment 16 of the present disclosure.

FIG. 16 is a schematic diagram of a combined heat recovery device according to Embodiment 16. In this embodiment, in addition to a final-stage extracted steam port 1, final-stage extracted steam 10, a final-stage feedwater heater 11 and a main steam pipe 2, there is additionally provided an additional pipe 01, a steam side regulating valve 02 on the additional pipe, heat exchangers 03 and 03' and an additional adjustable rear final-stage feedwater heater 05.

The main difference between Embodiment 16 and Embodiment 6 is that the heat exchangers 03 and 03' are connected not in parallel but in series, and the working substance heated by the heat exchangers may be different. For example, the heated working substance includes at least one of: boiler hot primary air, boiler hot secondary air, or boiler feed powder.

The method of using the device of Embodiment 16 is the same as the method of Embodiment 6, and is not to be described herein again.

Embodiment 17

Figure 17:
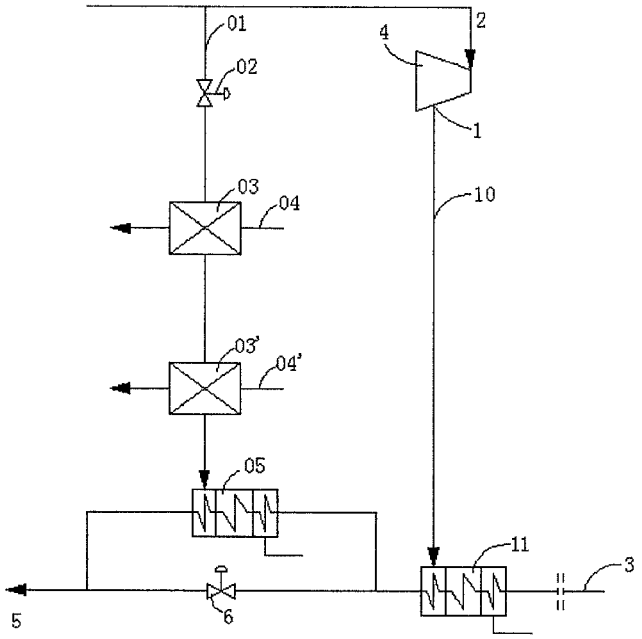
FIG. 17 is a schematic diagram of a combined heat recovery device according to Embodiment 17 of the present disclosure.

FIG. 17 is a schematic diagram of a combined heat recovery device according to Embodiment 17. In this embodiment, in addition to a final-stage extracted steam port 1, final-stage extracted steam 10, a final-stage feedwater heater 11 and a main steam pipe 2, there is additionally provided an additional pipe 01, a steam side regulating valve 02 on the additional pipe, heat exchangers 03 and 03', an additional adjustable rear final-stage feedwater heater 05 and a water side regulating valve 6.

The difference between Embodiment 17 and Embodiment 16 is that the water side regulating valve 6 is additionally provided and is connected in parallel with an additional adjustable rear final-stage feedwater heater 05. Therefore, the additional adjustable rear final-stage feedwater heater 05 may be designed as a partial capacity feedwater heater, and the cost of the heater is reduced.

The method of using the device of Embodiment 17 is different from the method of Embodiment 16 in that a temperature of the feedwater is a temperature of feedwater mixed from the outlet of the additional adjustable rear final-stage feedwater heater 05 and the outlet of the water side regulating valve 6.

The method of using the device of Embodiment 17 is the same as the method of Embodiment 16, and is not to be described herein again.

Embodiment 18

Figure 18:
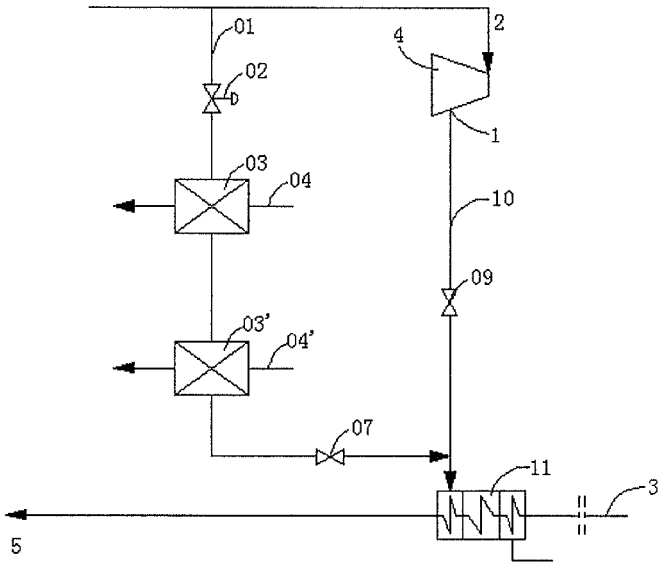
FIG. 18 is a schematic diagram of a combined heat recovery device according to Embodiment 18 of the present disclosure.

FIG. 18 is a schematic diagram of a combined heat recovery device according to Embodiment 18. In this embodiment, in addition to a final-stage extracted steam port 1, final-stage extracted steam 10, a final-stage feedwater heater 11 and a main steam pipe 2, there is additionally provided an additional pipe 01, a steam side regulating valve 02 on the additional pipe, and heat exchangers 03 and 03'.

The difference between Embodiment 18 and Embodiment 16 is that no additional adjustable rear final-stage feedwater heater 05 is additionally provided. Steam passing through the heat exchanger is directly sent to a final-stage feedwater heater 11 through a pipe. Embodiment 18 provides advantages that the additional adjustable rear final-stage feedwater heater 05 is saved, thereby reducing the investment, and the steam heat which is intended to be wasted by a bypass system can be recovered in the start-up stage of the unit as in Embodiment 16. On the other hand, the final-stage feedwater heater 11 may also be used for supplementing and heating feedwater, so that the temperature of the feedwater in the start-up stage is ensured, the requirements of denitration, stable hydrodynamic force, stable combustion, higher combustion efficiency and the like in the start-up stage are met, and the problems of low temperature condensation, ash blockage, corrosion and the like are avoided.

In the normal operation stage of the unit, when the load is higher, the final-stage extracted steam 10 may still be used to be heated by the final-stage feedwater heater 11, and when the load is low to a preset degree, an isolation valve 09 may be closed, the heat exchanger inlet isolation valve 06 and the heat exchanger outlet isolation valve 07 are opened, and the additionally provided system is switched to for operation. That is, main steam is used for performing, through the heat exchangers 03 and 03', at least one of the following operations: heating the boiler hot secondary air, and heating the boiler hot primary air and the boiler feed powder, and then for supplementing and heating boiler feedwater. When the original system needs to be switched back, the heat exchanger inlet isolation valve 06 and the heat exchanger outlet isolation valve 07 are closed. Therefore, the online switching and operation of two paths of steam to the final-stage feedwater heater 11 can be completely achieved through the isolation valve 09, the heat exchanger inlet isolation valve 06 and the heat exchanger outlet isolation valve 07.

The method of using the device of Embodiment 18 is the same as the method of Embodiment 16, and is not to be described herein again.

Embodiment 19

Figure 19:
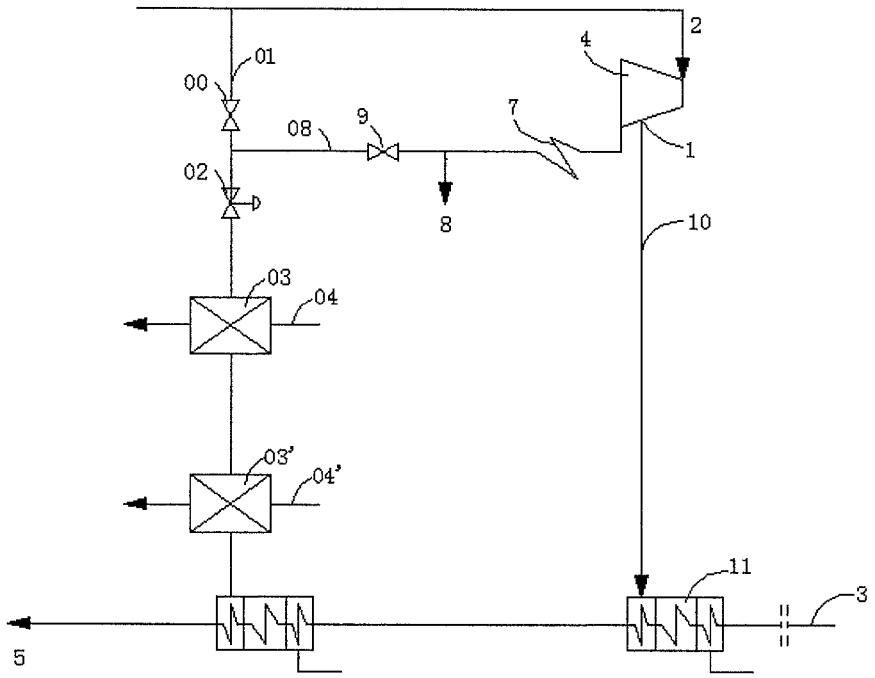
FIG. 19 is a schematic diagram of a combined heat recovery device according to Embodiment 19 of the present disclosure.

FIG. 19 is a schematic diagram of a combined heat recovery device according to Embodiment 19. In this embodiment, in addition to a final-stage extracted steam port 1, final-stage extracted steam 10, a final-stage feedwater heater 11 and a main steam pipe 2, there is additionally provided an additional pipe 01, an isolation valve 00 and a steam side regulating valve 02 on the additional pipe, heat exchangers 03 and 03' and an additional adjustable rear final-stage feedwater heater 05. An additional reheat pipe 08 to the heat exchanger 03 is additionally provided on the steam pipe located from a reheater to a medium pressure cylinder.

The difference between Embodiment 19 and Embodiment 16 is that the additional reheat pipe 08 to the heat exchanger is additionally provided. Embodiment 19 provides advantages that in the start-up stage of the unit, to protect the reheater, a part of steam has to be heated by the reheater 7 through the bypass system (high bypass) and then becomes reheat, and in the conventional case, the part of reheat is sent to the condenser through the bypass system (low bypass), while in the solution of the present disclosure, the additional reheat pipe 08 to the heat exchanger 03 is additionally provided, so the reheat steam flowing through the reheater in the start-up stage can be recovered. The isolation valve 9 is provided, so the switching between and operation of the inlet steam of the 08 path and the inlet steam of the 01 path can be achieved.

The rest in Embodiment 19 is consistent with those in Embodiment 16 and is not to be described in detail herein.

Embodiment 20

Figure 20:
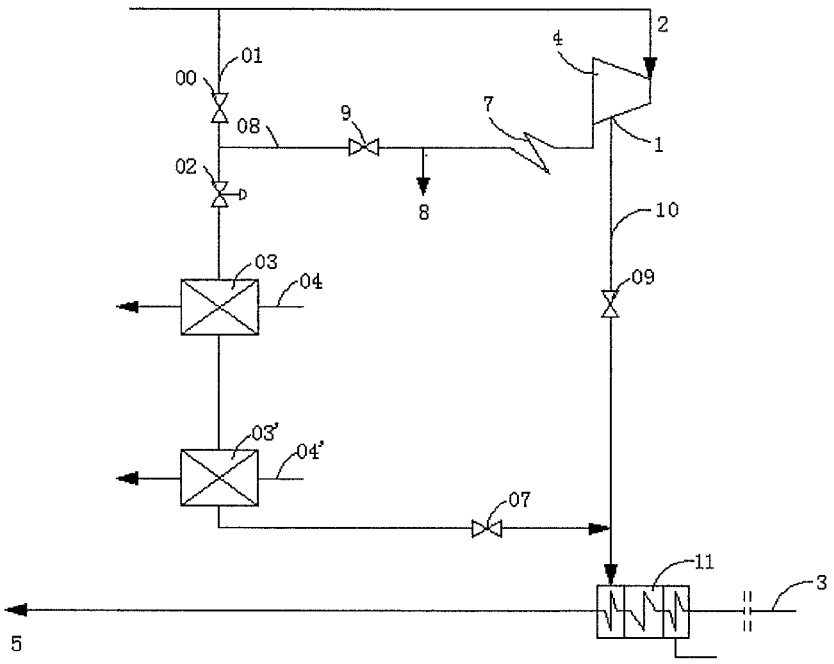
FIG. 20 is a schematic diagram of a combined heat recovery device according to Embodiment 20 of the present disclosure.

FIG. 20 is a schematic diagram of a combined heat recovery device according to Embodiment 20. In this embodiment, in addition to a final-stage extracted steam port 1, final-stage extracted steam 10, a final-stage feedwater heater 11 and a main steam pipe 2, there is additionally provided an additional pipe 01, an isolation valve 00 and a steam side regulating valve 02 on the additional pipe, heat exchangers 03 and 03' and an additional adjustable rear final-stage feedwater heater 05. An additional reheat pipe 08 to the heat exchanger 03 is additionally provided on the steam pipe located from a reheater to a medium pressure cylinder.

The difference between Embodiment 20 and Embodiment 19 is that no additional adjustable rear final-stage feedwater heater 05 is additionally provided. Steam passing through the heat exchanger is directly sent to the original final-stage feedwater heater 11 through a pipe. Embodiment 20 provides advantages that the additional adjustable rear final-stage feedwater heater 05 is saved, thereby reducing the investment, and the steam heat which is intended to be wasted by a bypass system can be completely recovered in the start-up stage of the unit as in Embodiment 4. On the other hand, the original final-stage feedwater heater 11 may also be used for supplementing and heating feedwater, so as to ensure the temperature of the feedwater in the start-up stage, the requirements of denitration, stable hydrodynamic force, stable combustion, high combustion efficiency and the like in the start-up stage are met, and the problems of low temperature condensation, ash blockage, corrosion and the like are avoided.

In the normal operation stage of the unit, when the load is higher, the final-stage extracted steam 10 may still be used to be heated by the final-stage feedwater heater 11, and when the load is low to a preset degree, an isolation valve 09 and an isolation valve 9 may be closed, a heat exchanger outlet isolation valve 07 is opened, and the additionally provided system is switched to for operation. That is, main steam is used for heating the boiler feed air or boiler feed power through the heat exchanger 03, and then supplementing and heating boiler feedwater. The heat exchanger outlet isolation valve 07 is closed when the original system needs to be switched back.

The rest in Embodiment 20 is consistent with those in Embodiment 19 and is not to be described in detail herein.

The foregoing has described in detail some illustrative embodiments of the present application. It is be noted that the combined heat recovery device of the present application may be combined in various manners depending on whether the water side is provided with the water side regulating valve, whether the additional adjustable rear final-stage feedwater heater is provided, a position of the extracted steam regulating valve, different capacities of the additional adjustable rear final-stage feedwater heater, different heating media of the heat exchanger, the number of heat exchangers, whether isolation valves and bypasses are provided in front of and behind the heat exchanger, the manner of connecting different heat exchangers, whether the additional reheat pipe to the heat exchanger is provided and the like.

What is claimed is:

1. A combined heat recovery device, comprising:

a high pressure cylinder of a steam turbine;

a main steam pipe;

a final-stage steam extraction pipe;

a heat exchanger, using a main steam in the main steam pipe as a heat source, wherein a working substance heated by the heat exchanger comprises at least one of: boiler hot secondary air, boiler hot primary air, or boiler feed powder, so that heat is sent into a boiler associated with the heat exchanger and fuel of the boiler is replaced;

a feedwater heater, using a discharged steam from the heat exchanger as a heat source;

an additional pipe, arranged on the main steam pipe and configured to connect the heat exchanger with the feedwater heater in series; and a steam side regulating valve, arranged on the additional pipe and configured to regulate the main steam in the additional pipe, wherein the steam side regulating valve is operative to control a pressure of extracted steam behind the steam side regulating valve to control an outlet temperature of the feedwater heater to reach a preset feedwater temperature.

2. The combined heat recovery device of claim 1, wherein the steam side regulating valve is arranged on the additional pipe between the main steam pipe and the heat exchanger.

3. The combined heat recovery device of claim 1, wherein the heat exchanger is a single heat exchanger, or a heat exchanger group composed of a plurality of heat exchangers.

4. The combined heat recovery device of claim 3, wherein the heat exchanger group is composed of two or more heat exchangers connected in parallel or in series, or composed of three or more heat exchangers connected in series and in parallel in combination.

5. The combined heat recovery device of claim 1, further comprising an additional reheat pipe additionally provided on a reheat pipe, wherein the additional reheat pipe is connected with the additional pipe additionally provided on the main steam pipe in parallel and is then connected to the heat exchanger and the feedwater heater.

6. The combined heat recovery device of claim 5, wherein the feedwater heater is a final-stage feedwater heater, the additional pipe is connected to the heat exchanger and the final-stage feedwater heater, and an isolation valve is provided on the final-stage steam extraction pipe.

7. The combined heat recovery device of claim 5, wherein the feedwater heater comprises an additional adjustable rear final-stage feedwater heater, and the additional pipe is connected to the heat exchanger and the additional adjustable rear final-stage feedwater heater.

8. The combined heat recovery device of claim 7, further comprising at least one water side regulating valve connected in parallel with the additional adjustable rear final-stage feedwater heater.

9. The combined heat recovery device of claim 2, further comprising an additional reheat pipe additionally provided on a reheat pipe, wherein the additional reheat pipe is connected with the additional pipe additionally provided on the main steam pipe in parallel and is then connected to the heat exchanger and the feedwater heater.

10. The combined heat recovery device of claim 9, wherein the feedwater heater is a final-stage feedwater heater, the additional pipe is connected to the heat exchanger and the final-stage feedwater heater, and an isolation valve is provided on the final-stage steam extraction pipe.

11. The combined heat recovery device of claim 9, wherein the feedwater heater comprises an additional adjustable rear final-stage feedwater heater, and the additional pipe is connected to the heat exchanger and the additional adjustable rear final-stage feedwater heater.

12. The combined heat recovery device of claim 11, further comprising at least one water side regulating valve connected in parallel with the additional adjustable rear final-stage feedwater heater.

13. The combined heat recovery device of claim 3, further comprising an additional reheat pipe additionally provided on a reheat pipe, wherein the additional reheat pipe is connected with the additional pipe additionally provided on the main steam pipe in parallel and is then connected to the heat exchanger and the feedwater heater.

14. The combined heat recovery device of claim 13, wherein the feedwater heater is a final-stage feedwater heater, the additional pipe is connected to the heat exchanger and the final-stage feedwater heater, and an isolation valve is provided on the final-stage steam extraction pipe.

15. The combined heat recovery device of claim 13, wherein the feedwater heater comprises an additional adjustable rear final-stage feedwater heater, and the additional pipe is connected to the heat exchanger and the additional adjustable rear final-stage feedwater heater.

16. The combined heat recovery device of claim 15, further comprising at least one water side regulating valve connected in parallel with the additional adjustable rear final-stage feedwater heater.

17. The combined heat recovery device of claim 4, further comprising an additional reheat pipe additionally provided on a reheat pipe, wherein the additional reheat pipe is connected with the additional pipe additionally provided on the main steam pipe in parallel and is then connected to the heat exchanger and the feedwater heater.

18. The combined heat recovery device of claim 17, wherein the feedwater heater is a final-stage feedwater heater, the additional pipe is connected to the heat exchanger and the final-stage feedwater heater, and an isolation valve is provided on the final-stage steam extraction pipe.

19. The combined heat recovery device of claim 17, wherein the feedwater heater comprises an additional adjustable rear final-stage feedwater heater, and the additional pipe is connected to the heat exchanger and the additional adjustable rear final-stage feedwater heater.

* * * * *